United States Patent [19]

Rossi

[11] 4,385,936

[45] May 31, 1983

[54] METHOD FOR CLEANING A PROCESS MONITORING PROBE

[75] Inventor: Gregory R. Rossi, Valparaiso, Ind.

[73] Assignee: Bethlehem Steel Corporation, Bethlehem, Pa.

[21] Appl. No.: 299,451

[22] Filed: Sep. 4, 1981

Related U.S. Application Data

[62] Division of Ser. No. 174,322, Aug. 1, 1980, Pat. No. 4,307,741.

[51] Int. Cl.[3] ..... B08B 3/02

[52] U.S. Cl. ..... 134/18; 134/36

[58] Field of Search ..... 134/93, 95, 98–101, 134/104, 113, 10, 18, 26, 28, 29, 36, 40

[56] References Cited

U.S. PATENT DOCUMENTS

| | | | |
|---|---|---|---|
| 2,038,260 | 4/1936 | Ash | 134/99 X |
| 2,621,673 | 12/1952 | Hodgens | 134/93 X |
| 2,732,502 | 1/1956 | Darney | 134/95 X |
| 3,120,326 | 2/1964 | Hedeman | 222/144.5 |
| 3,830,248 | 8/1974 | Brown | 134/100 |
| 4,244,749 | 1/1981 | Sachs et al. | 134/18 X |

*Primary Examiner*—Marc L. Caroff

*Attorney, Agent, or Firm*—Joseph J. O'Keefe; Michael J. Delaney; Anson W. Biggs

[57] ABSTRACT

A process monitoring probe within a sample container is cleaned by flushing a sample process stream from the container and then discharging a jet of water from a nozzle at the probe within the container. A chemical cleaning agent is injected into the water to be discharged from the nozzle.

1 Claim, 4 Drawing Figures

METHOD FOR CLEANING A PROCESS MONITORING PROBE

This is a division of application Ser. No. 06/174,322, filed Aug. 1, 1980, now U.S. Pat. No. 4,307,741.

BACKGROUND OF THE INVENTION

The present invention relates to cleaning process monitoring equipment and more particularly to cleaning probe apparatus for monitoring the chemistry of wastewater effluent.

Virtually all heavy industries and municipalities use sensing devices to monitor the chemistry of their wastewater effluent in order to maintain water quality acceptable to environmental control agencies. Process monitoring equipment including sensing probes for monitoring conductively, chlorine, B.O.D., pH, etc. The probes extend into the process stream and are subject to fouling by oil, dirt and other debris, resulting in errors in the readings.

Frequent cleaning of the process monitoring or sensing probe, e.g. once or twice a day, is necessary to assure accurate readings. Previous methods for cleaning process monitoring probes subject to fouling with debris include (a) removal of probe from the process and cleaning with a brush and solvent, (b) use of brushes and/or wipers while in service, and (c) use of a sonic device to vibrate the process fluid as it passes the probe. These methods either subject the probes to physical damage and/or are ineffective to remove the deposits on the probes. Attempts have been made by manufacturers to develop effective ultrasonic and/or mechanical means for cleaning the heavy sludge and grease accumulations from protuberances of the sensing end of the probe. The results have been a buildup of debris in the various metal prongs, glass electrode, etc. extending from the sensing end of the probe.

When the sensing or business end of the process monitoring probe becomes fouled as noted hereinabove by suspended solids, grease, oil, ore fines, etc. The potential across the measuring electrodes is affected. If the electrodes are not cleaned the measurement probe usually becomes inactive. Typically, these types of probes are removed and cleaned manually once or twice a day.

In addition, the plumbing of the sampling unit where the process monitoring probe is mounted is subject to a buildup of heavy grease and solids deposited on the walls of the pipes and frequent flushing of all parts of the unit is desirable to promote a clean sampling atmosphere.

SUMMARY OF THE INVENTION

It is, therefore, an object of this invention to provide a unique process monitoring probe cleaner that overcomes the above-mentioned deficiencies.

It is a further object of this invention to provide automatic means for cleaning a process monitoring probe.

It is yet another object of this invention to provide a method for in-situ automatic cleaning of a process monitoring probe.

The present invention accomplishes these objects by providing apparatus which includes the necessary plumbing for a flushing water supply, pump means to provide a high pressure jet stream mixed with a cleansing agent to be applied to the end of the process monitoring probe inserted into a process stream being monitored and valve means to control the flow of the flushing water. The apparatus further includes control logic means including a sequential timer connected to the system for automatic control of the system.

Other objects and advantages of the invention will appear from the following detailed description which, considered with the accompanying drawings, discloses a preferred embodiment of the invention for purposes of illustration only. For definition of the scope of the invention, reference will be made to the appended claims.

DESCRIPTION OF THE PREFERRED EMBODIMENT

Figure 1:
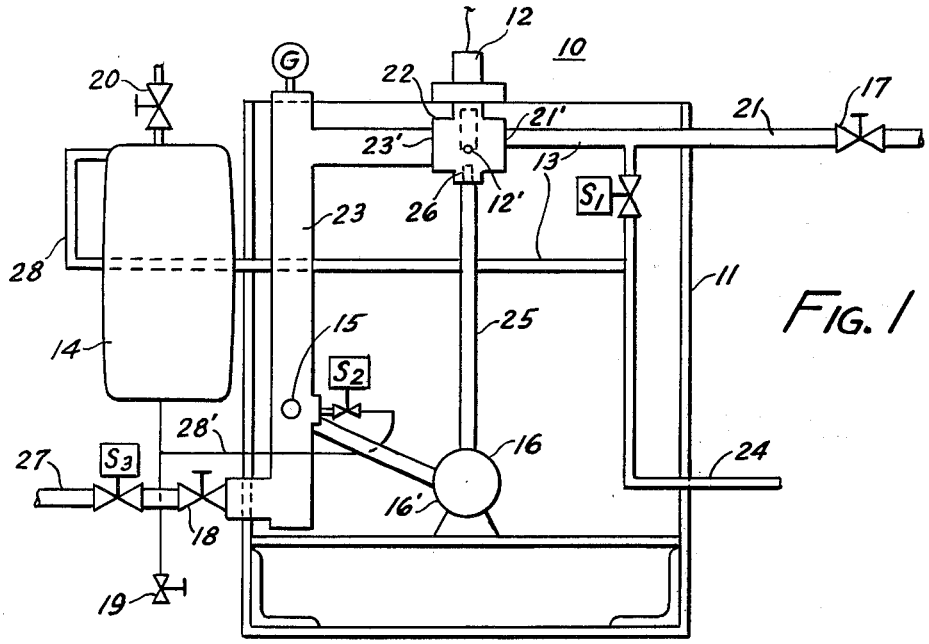
FIG. 1 is a front view of the probe cleaning apparatus.

Referring now to the Figures and particularly to FIG. 1, the probe cleaning apparatus 10 is seen to include generally a housing 11, probe 12, plumbing 13, cleansing agent cannister 14, sump 15, pump 16 and solenoid valves S1, S2 and S3. Manual valves 17, 18, 19 and 20 are provided for purposes that will become apparent hereinafter through the detailed description of the apparatus.

The plumbing 13 comprises a process stream sample inlet 21, e.g. 1" $\phi$ plastic pipe, ½" $\phi$ flushing water supply line 24, pump discharge line 25 with high pressure water jet nozzle 26 mounted on the end thereof. Drain line 27 is provided downstream of the solenoid valve S3 to drain the system. The direction of flow of flushing water through the system is altered by closing solenoid valve S3 as will become apparent in the detailed description of the apparatus hereinbelow. Flushing water piping 28 is provided to supply an appropriate amount of pressure to the cleansing agent cannister 14 so that the cleansing agent is actually injected into the system under pressure via pipe 28' when solenoid valve S2 is energized. All piping or tubing is stainless steel or plastic to avoid corrosion problems.

Valve 17 is a manual valve to permit the control of flow of a sample from the process stream, e.g. wastewater effluent. The sample flows through pipe 21, through sample container 22 and is discharged through outlet piping 23 which, because of its relatively larger size over the inlet pipe 21, acts as a sump for collecting the discharged sample until it flows out drain line 27 when manual valve 18 is opened S3 also being open. Valve 20 is opened to permit refilling cleansing agent cannister 14 and valve 19 provides for flushing and draining the cannister. Valves 17 and 18 are normlly open and valves 19 and 20 are normally closed. Gauge G is mounted, as shown on FIG. 1, on outlet piping 23 to monitor the sample flow pressure. The operation of solenoid valves S1, S2 and S3 will be described presently.

The apparatus for cleaning a process monitoring probe 12 inserted into a sample process stream for monitoring the chemistry of the process stream comprises a housing 11 in which sample container 22 is mounted having an inlet side 21' and a discharge side 23' and in which the process monitoring probe 12 is inserted. A cannister 14 for containing a cleansing agent, as e.g., an alkaline detergent liquid or a more acidic cleaning solution in cases where a lime coating on the probe occurs, and having inlet and discharge means is mounted on the outside of housing 11 adjacent the sample container 22. Sump means 15 is connected to piping 23 on the discharge side 23' of the sample container 22 and discharges to drain 27. A pump 16 having a suction side 16' is connected to sump 15. Pump 16 discharges into pump discharge line 25. A water jet nozzle 26 is connected to pump discharge line 25 and is inserted into sample container 22 adjacent the process monitoring probe 12.

A first valve S1 is mounted in the flushing water supply line 24 and second valve S2 is connected to cleansing agent cannister 14 and to the suction side 16' of pump 16. A third valve S3 is mounted on the discharge side 23' of sample container 22 to control the draining and flushing of the apparatus 10. Valves S1, S2 and S3 as shown in the preferred embodiment are solenoid valves and are electrically connected to a sequential timer and control logic equipment (see FIG. 3).

Figure 2:
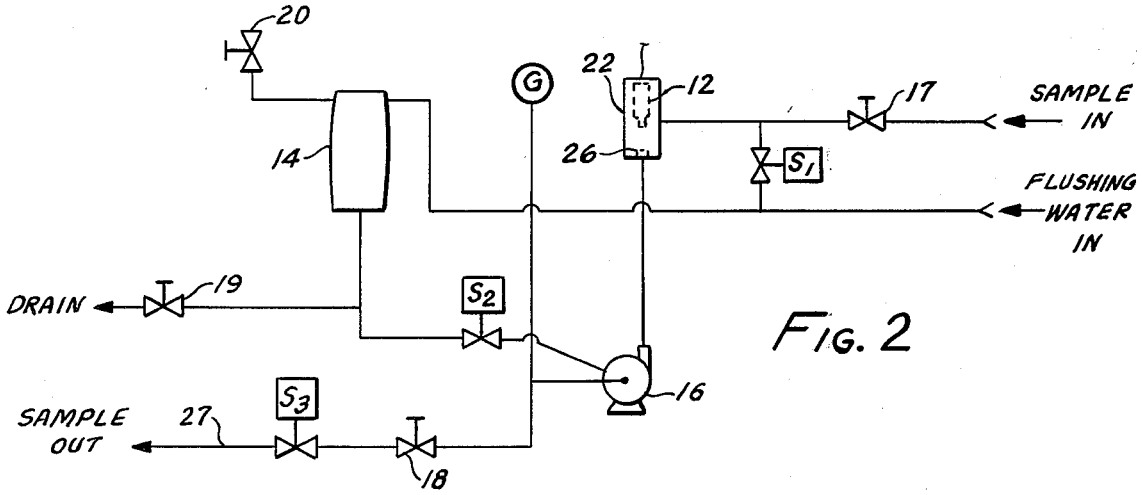
FIG. 2 is a schematic diagram of the probe cleaning system.

FIG. 2 is a schematic diagram of the process monitoring probe cleaning system of the instant invention. Valve 17 is normally open to allow a sample of the process stream to flow from the process stream header (not shown) into the sample container 22 where a process monitoring probe 12 inserted into the sample process stream through the sample container monitors the sample. Valve 18 is normally open to allow the sample to flow through the apparatus and drain through line 27 during the monitoring cycle. The cleansing agent cannister 14 is flushed and/or drained by opening valve 19 and is refilled through valve 20. Solenoid valves S1, S2 and S3 are involved only in the probe cleaning cycle.

When the electrodes, etc. projecting from the bottom of probe 12 become fouled by debris and cleaning of the probe becomes necessary the cleaning operation is initiated. Solenoid valve S1, normally closed, is opened and flushing water under relatively greater pressure than the sample stream flow enters the plumbing system of the apparatus. Solenoid valve S3 which is normally open remains open allowing the mixture of flushing water and sample to be flushed through the pipe 23 and drain out through pipe 27. Solenoid valve S2 normally closed remains closed for a period during this initial flushing. Solenoid valves S2 and S3 and pump motor 16 are energized to close valve S3, start pump 16 and open cleansing agent valve S2. The cleansing agent is allowed to flow and mix with the flushing water for a short period and then valve S2 is closed. The pump 16 draws water on its inlet side 16' from sump 15 to discharge a stream of cleaning water at times mixed with a cleansing agent through pump discharge line 25 and through water jet nozzle 26 at a high pressure at the sensing end 12' of process monitoring probe 12 to dislodge particles of debris therefrom and wash the sludge and grease freed therefrom away. With solenoid valve S3 closed and pump 16 actuated the flow of flushing water overcomes the sample flow and flows into the process stream header. The mixture of cleansing agent and flushing water is captured in a closed loop cycle where it is pumped in a continuous circular motion as it cleans the probe. As long as S3 is closed and S1 is open the cleansing agent and water solution does not escape. When the probe cleaning cycle is complete solenoid valves S1, S2 and S3 return to their normal attitude and the monitoring mode is reestablished.

SPECIFIC EXAMPLE

The following specific example described in detail a typical installation of the instant invention for cleaning a process monitoring probe.

The process monitoring probe cleaning apparatus comprises an arrangement of plumbing, solenoid valves, water pump, cleansing agent cannister and sequential timing logic box mounted in a suppport panel. The process to be monitored flows through the apparatus and the process monitoring probe accumulates grease, sludge and debris on the projections 12' of the probe 12 requiring periodic cleaning thereof. A supply of relatively clean flushing water under pressure, i.e. tap lake etc., is introduced through flushing water supply line 24 by energizing solenoid valve S1, under a pressure of 20–60 psi to flush all piping of sediment and debris. The flow of process sample through sample inlet 21 is at a relatively low pressure of about 7 psi. After a period of 60 seconds the normally open sollenoid valve S3 is energized to close drain pipe 27. This allows the remaining cycle to operate under conditions of relatively clean water, blocks the sample from becoming involved in the cleaning process and contributes to continuous flushing of the plumbing for the balance of the cycle. The system is now in effect closed.

Pump 16 is actuated simultaneously with the energization of solenoid valve S3 and draws clean water from sump 15 downstream of the probe and directs the water under pressure through a water jet nozzle at an area immediately below the probe electrodes. At the same time solenoid valve S2 is energized to open and permit a cleansing agent solution, e.g., an industrial alkaline detergent liquid, to be injected into the pump inlet for a period of 10 seconds. The mixing of the cleansing agent with the clean water in the pump creates a froth which aids in cleaning grease and sludge from the probe. The washing cycle continues for a period until the probe is clean, a time selected by the operator and controlled by the preset timing mechanism. Solenoid valve S3 is energized to open and S2 is energized to close to end the cleaning cycle. S1 is energized to close and thus stop the flow of the flushing water and return the system to the sample monitoring mode.

Figure 3:
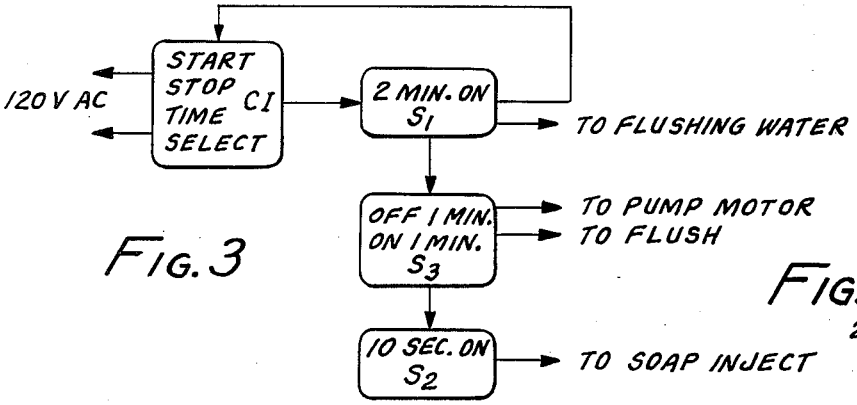
FIG. 3 is a block diagram of the control logic means for sequential timing of the apparatus.
Figure 4:
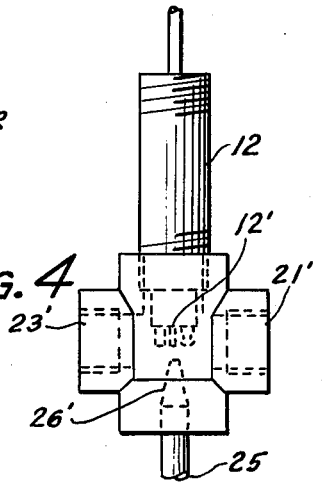
FIG. 4 is an enlarged fragmentary section of a portion of the probe cleaning apparatus.

Referring now to FIG. 3 which is a block diagram of the control logic means for sequential timing of the probe cleaning apparatus, when the cycle is started the clock impulse, C1, calls for a "2 minute on" period. The flushing water solenoid S1 is energized simultaneously with a 60 second off-delay. The remainder of the system waits until this period times out. After the 60 second off-delay times out, the remainder of the system is energized—the pump 16 turns on, solenoid valve S3 closes and the cleansing agent solenoid valve S2 is energized for 10 seconds. The circuit uses low power T.T.L. circuitry.

All times are independently variable so that the cycle and each delay could be expanded, restricted or dovetailed. For example, by expanding the whole cycle to 3 minutes the flushing water could run for 1 minute before the drain is closed, the pump could run for the next minute, the cleansing agent could be dispensed for 20 seconds and the rinse could take up the third minute.

I claim:

1. A method for cleaning a process monitoring probe while inserted in a sample container through which flows a sample process stream, comprising the sequential steps of:

(a) injecting a supply of flushing water at a pressure between 20 and 60 psi into said sample process stream, (b) draining said flushing water and sample process stream, (c) ceasing draining of said flushing water and sample process stream, (d) discharging a jet of water from a nozzle at said inserted probe, (e) injecting a chemical cleansing agent into the water to be discharged from the nozzle, (f) ceasing injecting the supply of flushing water, ceasing discharging said jet of water and ceasing injecting the cleaning agent, (g) resuming draining of said sample process stream, and (h) providing sequential timer means for sequentially implementing steps a–g.

* * * * *